United States Patent [19]

Pachmayr et al.

[11] 4,242,824

[45] Jan. 6, 1981

[54] PISTOL GRIPS HAVING CUSHIONING RECESSES

[75] Inventors: Frank A. Pachmayr, Los Angeles; Jack R. Farrar, Whittier, both of Calif.

[73] Assignee: Pachmayr Gun Works, Inc., Los Angeles, Calif.

[21] Appl. No.: 764

[22] Filed: Jan. 3, 1979

[51] Int. Cl.[3] ..... F41C 23/00

[52] U.S. Cl. ..... 47/71 P

[58] Field of Search ..... 42/71 P, 74

[56] References Cited

U.S. PATENT DOCUMENTS

| | | | |
|---|---|---|---|
| 926,529 | 6/1909 | Wesson | 42/71 P |
| 1,049,739 | 1/1913 | Leach, Jr. | 42/71 P |
| 3,160,976 | 12/1964 | Pachmayr | 42/74 |
| 3,263,359 | 8/1966 | Pachmayr | 42/74 |
| 3,363,352 | 1/1968 | Pachmayr | 42/74 |
| 3,514,889 | 6/1970 | Pachmayr | 42/74 |
| 3,672,084 | 6/1972 | Pachmayr | 42/71 P |
| 3,683,535 | 8/1972 | Lewis | 42/71 P |
| 3,815,270 | 6/1974 | Pachmayr | 42/71 P |
| 4,043,066 | 8/1977 | Pachmayr et al. | 42/71 P |
| 4,132,024 | 1/1979 | Pachmayr et al. | 42/71 P |
| 4,148,149 | 4/1979 | Pachmayr et al. | 42/71 P |
| 4,162,586 | 7/1979 | Pachmayr | 42/71 P |

OTHER PUBLICATIONS

"Pachmayr Slip-On Recoil Pad," Pachmayr Gun Works, Inc.

*Primary Examiner*—Charles T. Jordan

*Attorney, Agent, or Firm*—William P. Green

[57] ABSTRACT

A pistol grip including a grip body of elastomeric material to be connected to the frame of a pistol and containing a recess within which a terminal portion of the frame extends downwardly, with the elastomeric material containing a cushioning recess which is located behind the first mentioned recess and gives to the grip body greater compressability in a front to rear direction to increase its absorption of recoil force upon firing of the gun.

34 Claims, 17 Drawing Figures

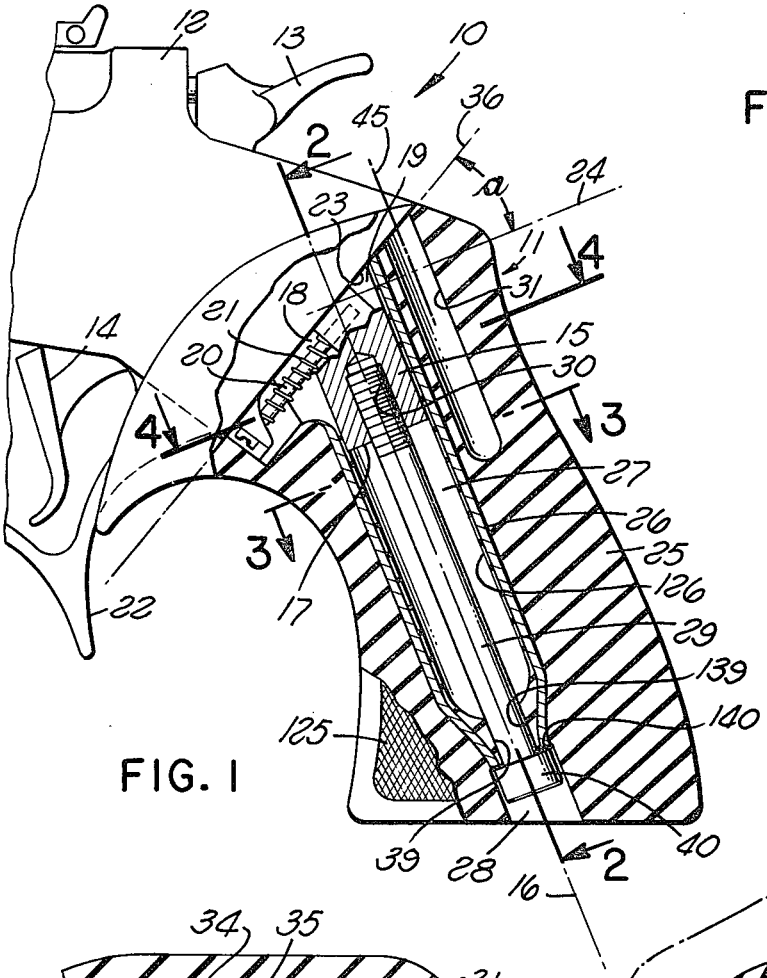
FIG. 1
FIG. 2
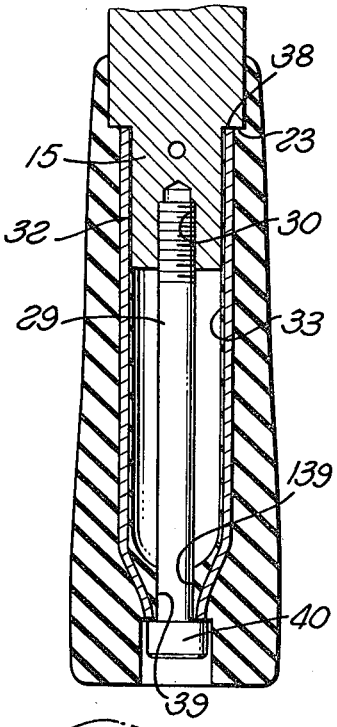
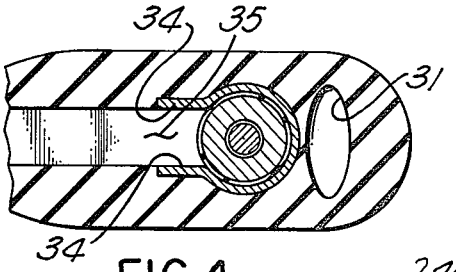
FIG.4
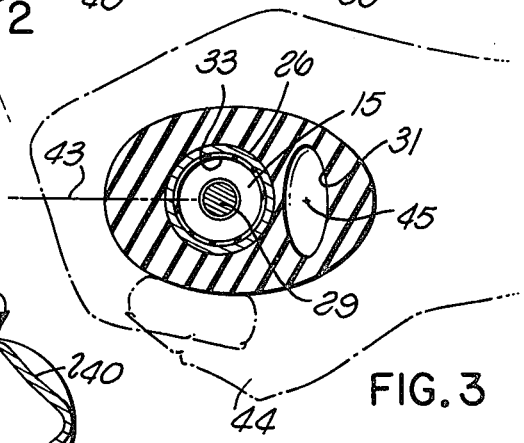
FIG. 3
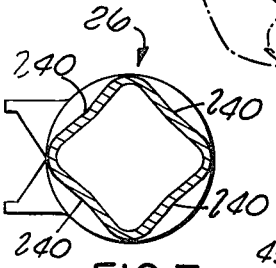
FIG.7
FIG.5
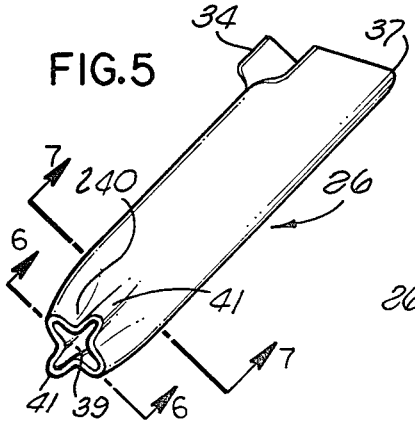
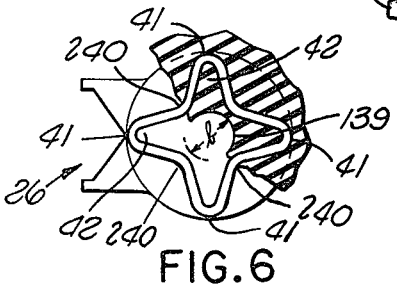
FIG.6
FIG.8
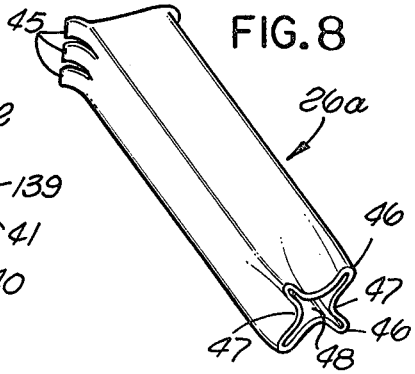

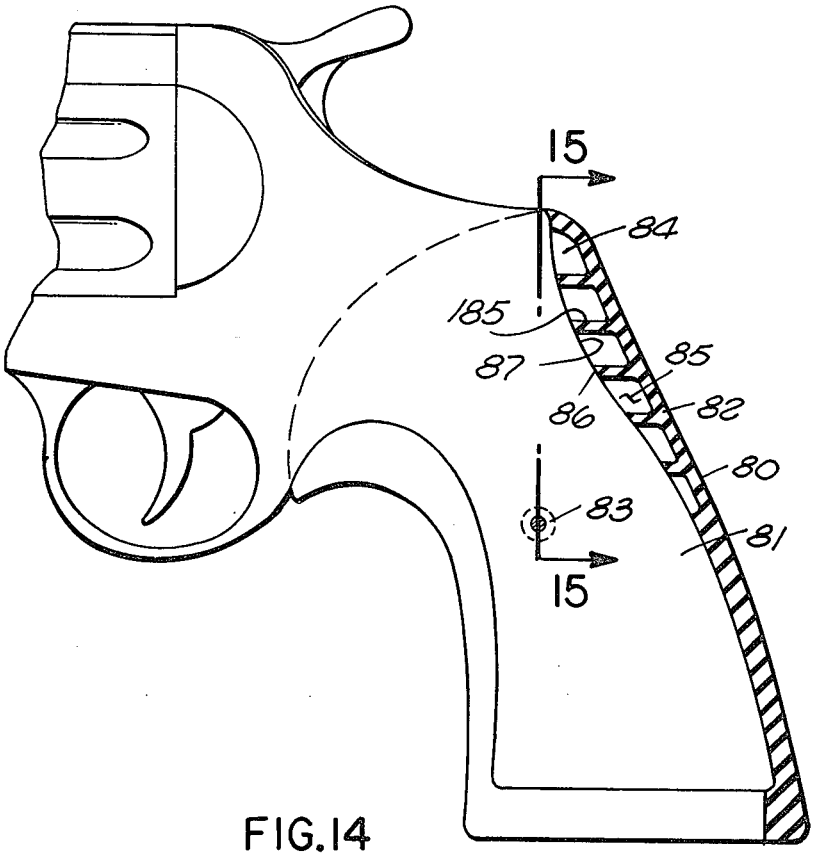
FIG.14
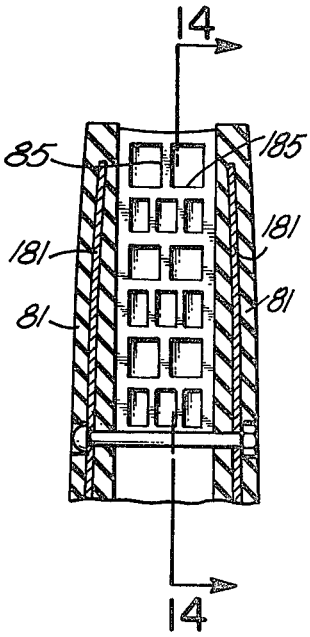
FIG. 15
FIG. 16
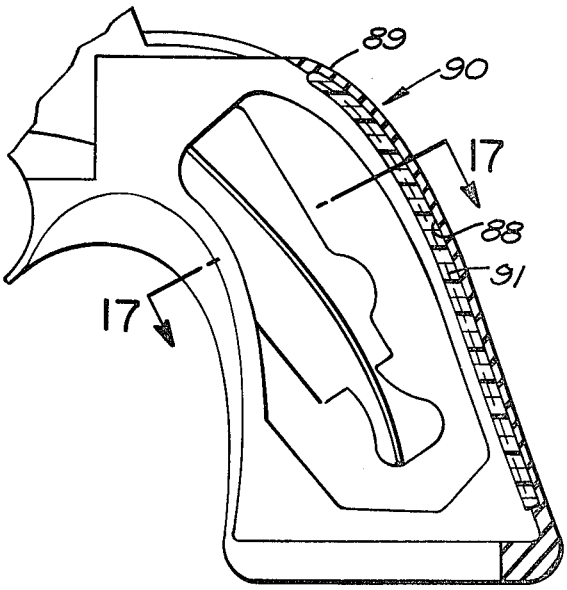
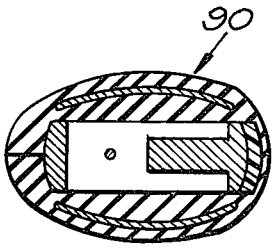
FIG.17

PISTOL GRIPS HAVING CUSHIONING RECESSES

BACKGROUND OF THE INVENTION

This invention relates to improved pistol grip devices having deformability to cushion the contact of a pistol handle with a user's hand.

The grips of the present invention are of a general type in which a body or bodies of elastomeric material are connected to the handle portion of a pistol, with the outer surfaces of the grip being formed of the elastomeric material for contact with a user's hand in a manner enabling slight cushioned deformation of those surfaces as a user grips the handle, to thereby soften the contact between the hand and the grip, and also increase the friction therebetween for preventing slipping of the gun in the user's hand. Certain prior grips of this general type have been disclosed in U.S. Pat. Nos. 3,672,084, 3,815,270, and 4,043,066, and in prior copending U.S. Patent Applications Ser. Nos. 838,805 filed Oct. 3, 1977 and 872,329 filed Jan. 25, 1978, now U.S. Pat. Nos. 4,132,024 and 4,148,149 respectively.

SUMMARY OF THE INVENTION

The general purpose of the present invention is to provide a gun grip of the above discussed general type in which the capacity for absorption of recoil of the gun is enhanced, to further minimize discomfort to the user upon firing of the gun. This result is achieved by provision in a rear portion of the elastomeric material of the grip of a cushioning recess, acting to give the rear portion of the grip body greater compressability in a front to rear direction than if the elastomeric material were solid at that location, to thereby increase the absorption of recoil force by the pistol grip upon firing. This cushioning recess is desirably located directly behind a rear portion of the gun frame, so that most of the recoiling force is transmitted rearwardly from that rear portion of the gun frame through the part of the elastomeric body which contains the cushioning recess, and so that as the body compresses in a front to rear direction at the location of the recess, the recoil force is absorbed and not applied directly and abruptly to the user's hand.

In one form of the invention, as applied to a grip similar to that shown in our above mentioned U.S. Pat. No. 4,148,149 the grip body contains a reinforcing structure which is stiffer than the elastomeric material of that body, and is desirably tubular in configuration, with a recess being provided in the composite body into which a terminal projection of the pistol frame is slidably insertable, and with the projection being retained in that recess by a fastener. A cushioning recess is then located rearwardly of the recess which receives the terminal projection of the gun frame, and desirably opens upwardly behind that other recess. In another form of the invention, similar to the grips shown in U.S. Pat. No. 4,132,024, the elastomeric body forms two opposite side portions receivable at opposite sides of a pistol handle, and interconnected by an integral rear strap portion extending across the back of the handle, but preferably not connected together at the front of the handle. The cushioning recess in this case desirably opens forwardly into a main recess within which the handle of the pistol is received, between the two opposite side sections. Those side sections preferably contain reinforcing plates, which are apertured to pass therethrough screws for securing the plate to the pistol handle and thereby positively retaining the entire grip structure on that handle.

BRIEF DESCRIPTION OF THE DRAWINGS

The above and other features and objects of the invention will be better understood from the following detailed description of the typical embodiments illustrated in the accompanying drawings, in which:

FIG. 1 is a side elevational view, partially broken away to a central sectional plane, of a first form of pistol grip constructed in accordance with the invention, shown applied to a pistol handle;

FIG. 2 is a section taken on line 2—2 of FIG. 1;

FIGS. 3 and 4 are transverse sections taken on lines 3—3 and 4—4 respectively of FIG. 1, with the grip being illustrated in FIG. 4 as it appears when detached from the gun frame;

FIG. 5 is a perspective representation of the reinforcing tube in the FIG. 1 device;

FIG. 6 is a bottom elevational view of the reinforcing tube, taken on line 6—6 of FIG. 5, and showing fragmentarily the elastomeric material of the grip;

FIG. 7 is a transverse section taken on line 7—7 of FIG. 5;

FIG. 8 is a perspective representation of a reinforcing element formed from square tubing;

FIG. 14 is a sectional view similar to FIG. 11, but showing another form of the invention;

FIG. 15 is a detailed view taken on line 15—15 of FIG. 14;

FIG. 16 is a view similar to FIG. 14, but showing still another form of the invention; and FIG. 17 is a section taken on line 17—17 of FIG. 16.

DESCRIPTION OF THE PREFERRED EMBODIMENTS

Figure 9:
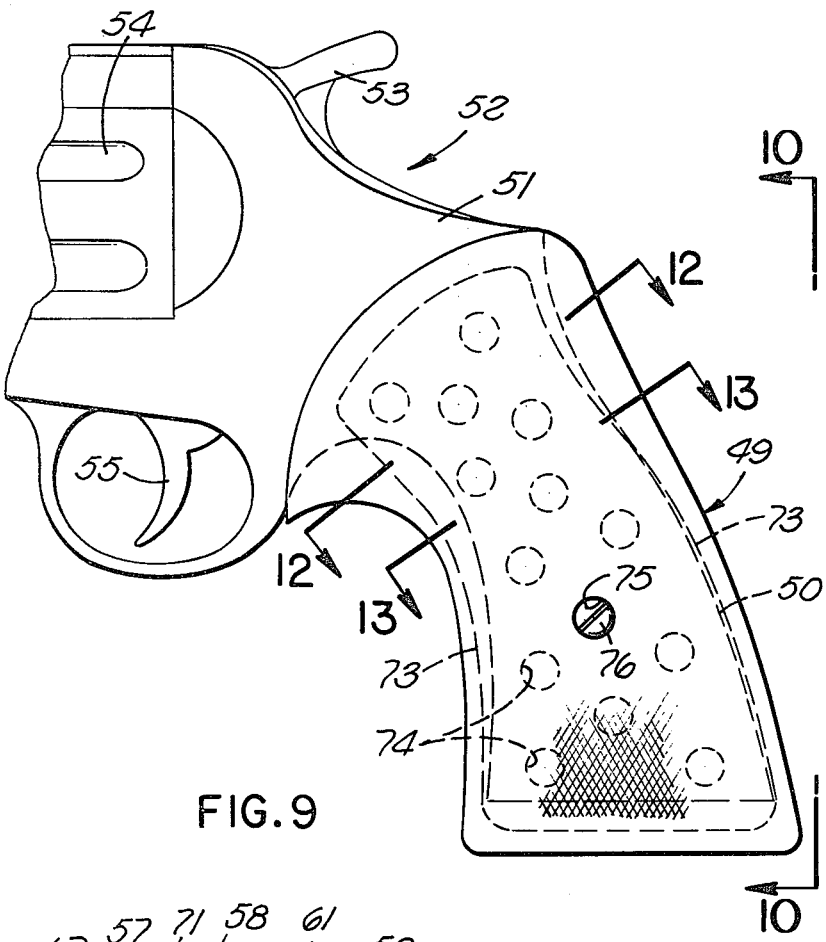
FIG. 9 is a side view of a second form of pistol grip embodying the invention.
Figure 10:
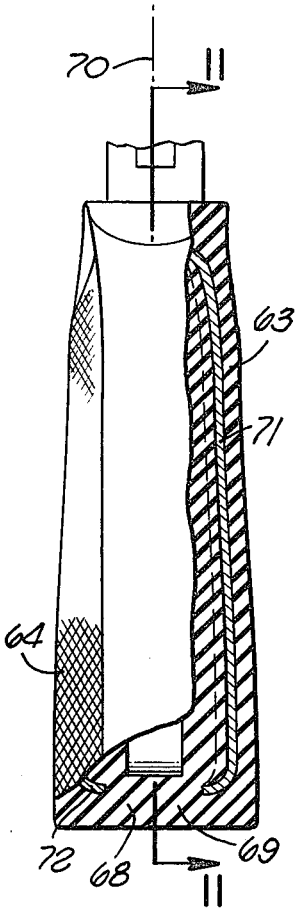
FIG. 10 is a rear elevational view taken on line 10—10 of FIG. 9, and partially broken away in section.

FIG. 1 illustrates fragmentarily at 10 a pistol which is of a known conventional construction except for attachment to the handle portion of the gun of a cushioned grip unit 11. The pistol includes a main rigid frame 12 formed of steel and movably carrying a hammer 13 for firing cartridges through the barrel of the pistol (not shown) under the control of a trigger 14. At its handle end, frame 12 has a rigid metal projection 15 which is integral with the remainder of the frame and extends along a downwardly and rearwardly inclined axis 16. This projection is utilized for attaching grip unit 11 to the pistol, and in the particular type of pistol illustrated is of circular cross-section transversely of axis 16, as seen in FIG. 3. At its lower end, projection 15 has an end wall 17 disposed transversely of axis 16. Near its upper end, the projection 15 has small recesses 18 and 19 at its front and rear sides defining a portion of the projection to which a pin 20 is connected for locating a surrounding coil spring 21 resisting limited pivotal movement of the trigger guard 22. Except as interrupted by recesses 18 and 19, the circular cross-section of projection 15 is uniform from its lower end 17 to an upper inclined shoulder 23 formed on the gun frame 12 about the upper extremity of the projection. Shoulder 23 is disposed at an angle a with respect to a plane 24 perpendicular to axis 16.

Grip unit 11 includes a main body 25 formed of rubber or another appropriate resiliently deformable elastomeric material, and includes also an inner reinforcing structure or part 26 embedded within and permanently bonded to the elastomeric material of body 25. These parts together form and contain an internal cylindrical recess 27 extending along and centered about axis 16 and dimensioned to closely receive projection 15 in interfitting relation. Recess 27 preferably extends downwardly a substantial distance beyond the lower end of projection 15, and communicates at its lower end with an inclined short passage 28 (FIG. 1) through which an elongated screw 29 is insertable into the recess for connection into a threaded bore 30 formed centrally in the lower portion of projection 15 to secure grip 11 on the projection.

At a location behind recess 27 and reinforcing part 26, the body 25 of elastomeric material contains a cushioning recess 31, with which the present invention is especially concerned. This recess acts to increase the compressability of the rear portion of the rubber body in a front to rear direction to assist in absorbing recoil force and avoid discomfort to the user's hand on firing.

The elastomeric material which forms body 25 may be an appropriate natural or synthetic rubber, desirably neoprene, having sufficient resilient deformability to effectively cushion the gripping contact of the user's hand with the pistol (preferably of a shore hardness between about 33 and 45 on the A scale). The outer surfaces of the elastomeric material may be irregularized, as by checkering 125 or the like, particularly at the sides of the grip.

The reinforcing part 26 is made of a material which is substantially stiffer or more rigid than the elastomeric material of grip body 25, and more particularly is preferably formed of steel or other metal having sufficient strength and rigidity to maintain its illustrated shape without deformation under all conditions of use of the gun. Part 26 is desirably formed of tubing, which in the FIG. 1 attached position is centered about axis 16, and which in the illustrated arrangement is of circular cross-section approximately the same as the external circular section of projection 15. In the optimum arrangement, the internal cylindrical surface 126 of part 26 has a cross-section just slightly greater than the outer cylindrical surface 32 of projection 15, to fit fairly closely on that projection, with a thin layer 33 of the elastomeric material of body 25 extending along the inner surface of the reinforcing tube to form the sidewall of the previously mentioned recess 27. This wall of the recess 27 is a close fit on projection 15 to hold the grip unit in fixed aligned relation with respect to projection 15 when the parts are assembled. The layer 33 of rubber at the inside of the tubular reinforcing part 26 is connected to the main portion of elastomeric body 25 at the upper and lower ends of the tube. The elastomeric material is continuously bonded to tube 26 over all of the surfaces of that part, to effectively integrate the grip structure.

The circular cross-section of tube 26 is uniform along the entire axial extent of that tube except at its upper and lower ends. Near its upper end, the cross-section is altered by forming a cut or slit in the tubing of part 26 at the front side of that part, and deforming the material of the tube to the shape illustrated in FIG. 4 in which two portions 34 of the tube wall extend forwardly parallel to one another to form a recess 35 within which the previously mentioned pin 20 and spring 21 are received. The upper extremity of tube 26 is truncated in an inclined plane 36 disposed at the same angle a with respect to plane 24 as is the discussed shoulder 23 on pistol frame 12, to form an upper edge of the tube 26 lying in the plane 36 and adapted to be clamped upwardly toward shoulder 23. A thin layer 38 of the elastomeric material which forms grip body 25 may extend across the upper edge 37 of the tube to contact shoulder 23.

The lower end of reinforcing tube 26 is deformed to provide a restriction or reduced diameter opening 39 at the bottom of the tube (FIG. 5) to which the enlarged head 40 of screw 29 applies upward clamping force to retain the grip on the pistol. To form restriction 39, the initially cylindrical sidewall of tube 26 is deformed inwardly at a number of evenly circularly spaced locations, preferably four such locations, to form as many inwardly deformed portions 240 of the tube wall spaced apart a distance b (FIG. 6) corresponding approximately to the external diameter of screw 29. Circularly between the inwardly deformed portions 240, the sidewall of the tube forms radially outwardly projecting portions 41 (FIG. 6), within which narrow radially extending gaps 42 are provided. The deformation of the lower end of the tube is such as to give the tube a cross-section similar to that shown in FIG. 6 for a substantial distance upwardly, with the depth of the deformations 240 gradually decreasing as represented in FIG. 7, ultimately to the circular cross-section of the remainder of the tube. The elastomeric material of body 25 extends upwardly within the gaps 42 to integrate the elastomeric material at the inside of the tube with that at its exterior and further assure an effective bond between the parts, with the elastomeric material within the lower deformed portion of the tube being shaped to define an inner cylindrical surface 139 forming a sidewall of restriction 39. The rubber forms a thin layer on the radially inner surfaces of the minimum diameter portions 240 of the deformed tube end. The diameter of fastener head 40 is great enough to simultaneously exert force upwardly against all four of the minimum diameter portions 240 of the deformed lower end of the tube to tightly clamp the tube upwardly against shoulder 23. As at the upper end, the lower end edges of the tube are coated by a thin layer 140 of the elastomeric material, received between the fastener head and the bottom of the tube, but of insufficient thickness to adversely affect the clamping action.

The cushioning recess 31 behind the upper portion of reinforcing tube 26 is vertically elongated and preferably extends essentially along an inclined axis 45 parallel to and directly behind main axis 16 of recess 27 and part 26. Recess 31 may be of uniform cross-section along its entire axial extent, desirably the transversely elongated generally elliptical cross-section shown in FIGS. 3 and 4. When the grip is assembled on the gun, a rear portion of the gun frame extends across and closes the upper end of the recess 31. Like the main recess 27, cushioning recess 31 opens upwardly at the top of the grip body to facilitate molding of the grip. In the illustrated arrangement, recess 31 is an air cavity, though it is contemplated that in some instances it may be desirable to fill the recess 31 with an appropriate resilient foam material or other resiliently compressable material having greater softness and compressability than the elastomeric material of the main body 25 of the grip. Recess 31 preferably extends only part of the way downwardly within body 25, desirably not over about one-half of the axial extent of body 25, to thereby localize the increased compressability of the body near its upper end, at the location at which maximum recoil force is applied to the user's hand, and thus attain optimum recoil absorption without unduly softening or weakening the lower portion of the body.

To install the grip unit 11 on pistol 10, after removal of a conventionally provided rigid grip element, unit 11 is first located to position its internal recess 27 axially opposite and beneath projection 15, following which unit 11 is moved upwardly and leftwardly along axis 16 relative to frame 12 and projection 15, with the projection moving slidably and axially into recess 27 and to the position of FIG. 1. Screw 29 is then pushed upwardly through restriction 39 and into the lower end of recess 27, and is threadedly connected into bore 30 in the projection and tightened to clamp reinforcing part 27 tightly upwardly against shoulder 23, and thereby effectively and rigidly retain the reinforcing part between head 40 and that shoulder. Such retention of the reinforcing part effectively integrates it with the frame of the pistol for handling as a unit. The user holds the grip in the manner represented in broken lines in FIG. 3, with the fingers 43 extending along one side of the grip and then across the front of the grip and rearwardly at the opposite side, and with the user's thumb 44 being received at that second side of the grip. The outer deformable surfaces of the grip body 25 assure an effective relatively high friction but cushioned contact of the hand with the grip. When the gun is fired, the recoiling force applied rearwardly by frame 12 of the pistol, and particularly by its projection 15, causes compression of the rear portion of body 25 in a front to rear direction at the location of cushioning recess 31, to absorb a great deal of the recoiling force and prevent its transmission to the user's hand. The result is a very substantial reduction in any discomfort which might otherwise be caused by the recoiling force. The positioning of the cushioning recess 31 near the upper end of body 25 locates the major portion of the cushioning effect of that recess at the location of the upper portion of the user's hand, which is the region in which greatest discomfort from recoil of a pistol normally occurs.

FIG. 8 illustrates a variational type of reinforcing tube **26*a* which may be substituted for the tube 26 of FIGS. 1 to 7 when the gun 10 is of a type having a projection 15 of square rather than circular cross-section. In FIG. 8, the reinforcing element 26*a* is formed of square rather than cylindrical tubing, slit and deformed at its upper edge to form tabs 45 for enhancing the bond between the reinforcing part and outer elastomeric body. At its lower end, the tube 26*a* is deformed in a manner similar to tube 26, and more specifically is deformed inwardly at four locations between the corners 46 of the square tube to form four similar reduced diameter portions 47 defining together a restriction 48 through which a retaining screw such as that shown at 29 in FIG. 1 can extend, with the head of the screw being large enough to bear upwardly against all four of the inwardly deformed portions 47. As in the first form of the invention, the deformation of the lower portion of the tube continues upwardly for a substantial axial distance, with the extent of deformation gradually decreasing and ultimately merging with the square cross-section of the major portion of the tube. Except with regard to the construction of the tube, the form of the invention represented in FIG. 8 is the same as that shown in FIGS. 1 to 7, and in particular includes an elastomeric body containing a cushioning recess corresponding to that illustrated at 31** in the first form of the invention for assisting in absorbing recoil force upon firing of the gun.

FIGS. 9 through 13 show another variational arrangement, in which a resilient grip device 49 is applied to the rigid handle or terminal portion 50 of the frame 51 of a conventional revolver 52 having a hammer 53 for firing cartridges from a revolving cylinder 54 under the control of a trigger 55 located in front of the handle portion of the pistol. Handle 50 is normally cast integrally with frame 51 of a single piece of metal shaped to the configuration illustrated in FIG. 11, and more particularly has a rear surface 56 which curves forwardly as it advances upwardly, and a forward surface 57 also curving forwardly near its upper end. The thickness of the handle between its parallel opposite side surfaces 58 and 59 is greater above a location 150 than beneath that location (see FIGS. 9, 11 and 13). An opening 61 may extend through the gun handle from one side to the other.

The pistol grip device 49 takes the form of a unitary body of reinforced elastomeric material which in use completely encircles and encloses the metal handle portion 50 of the pistol frame, and as in the case of the first form of the invention presents resiliently deformable outer surfaces for cushioned contact with a user's hand entirely about the handle. The rubber or other elastomeric material 62 of the grip device 49 may be similar to that used in the first form of the invention, and is molded to form two opposite side portions 63 and 64 received at opposite sides of and closely fitting handle 50, and interconnected integrally by a rear cross strap portion 65 extending across the back of handle 50 and containing a cushioning recess 66 for absorbing recoil force.

Figure 12:
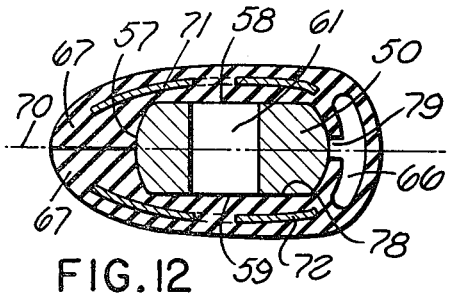
FIGS. 12 and 13 are transverse sections taken on lines 12—12 and 13—13 respectively of FIG. 9.
Figure 13:
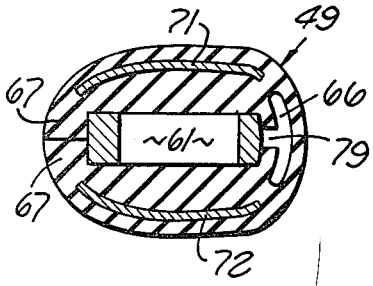

At the front of the handle, the molded elastomeric body 62 forms two flanges 67 which project inwardly toward one another to positions in front of the forward surface 57 of the handle, and desirably into direct contact in the FIGS. 12 and 13 installed position of the device. Similarly, body 62 may form two bottom flanges 68 and 69 extending inwardly and meeting one another at the bottom of the handle. Flanges 68 and 69, and the two flanges 67, may meet in the central vertical front to rear plane 70 of the gun. Embedded within the elastomeric material of the two side portions 63 and 64 of FIGS. 9 through 13, there are provided two essentially rigid preferably metal reinforcing plates 71 and 72, typically having the outline configuration illustrated at 73 in FIG. 9, with that configuration corresponding generally to the previously discussed side view shape of handle 12 as seen in FIG. 9. Plates 71 and 72 contain apertures 74 through which some of the elastomeric material extends to assure adequate bonding of the reinforcing plates to the elastomeric material. The two side portions 63 and 64 and their reinforcing plates are mirror images of one another, and contain registering apertures 75 near their centers through which a screw 76 extends to secure the two side sections together and tightly against opposite sides of the handle. The portions of these apertures which are formed in reinforcing plates 71 and 72 are openings in those plates of a size to just pass the reduced diameter shank of screw 76, and smaller than the head of the screw and a nut 176 connected thereto, so that one of the plates may engage or take the force exerted by the head of the screw, while the other plate engages or takes the force exerted by the nut, to thereby clamp the opposite side portions 63 and 64 against the gun handle. The reinforcing plates are curved concavely inwardly as shown, in corespondence with the similarly curving contour of the outer side surfaces of the elastomeric body of the grip.

The elastomeric material of the rear cross strap portion 65 of body 62 is molded integrally with and forms a continuation of the elastomeric material of the two opposite side sections 63 and 64, to permanently interconnect those sections from the lower end of the grip body to an upper location 77.

Figure 11:
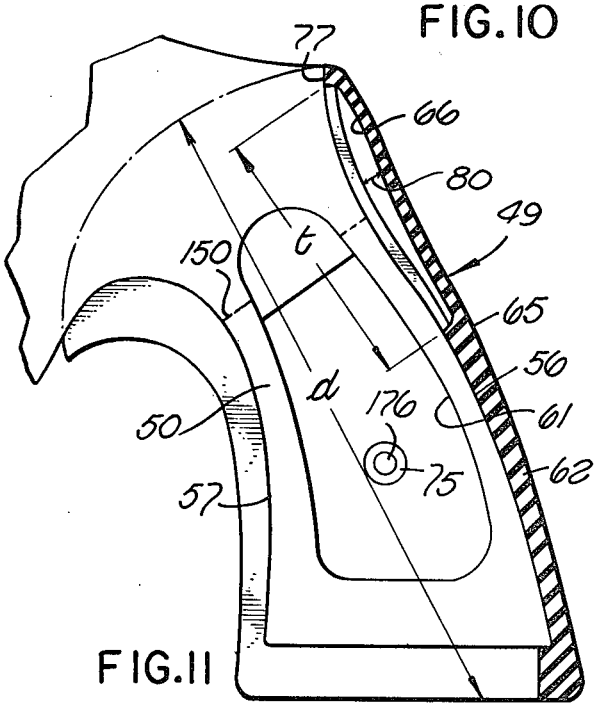
FIG. 11 is a vertical section taken on line 11—11 of FIG. 10.

The cushioning recess 66 formed in the rear cross strap portion 65 of grip 49 is desirably located in the upper portion of the grip, as in the first discussed form of the invention, and as in that first arrangement preferably has a generally vertical length t not substantially greater than about one-half of the length d in the same direction of the elastomeric grip body. As seen in FIGS. 12 and 13, the recess 66 may be in communication with the main internal recess 78 of the grip within which handle 50 is received, with that communication being provided by a vertically elongated slit 79 extending between recesses 66 and 78 and forming with recess 66 a generally T-shaped cross-section. As seen in FIG. 11, the depth of recess 66 in a front to rear direction may be at a maximum at a location 80 intermediate its upper and lower ends, and may progressively decrease toward the upper and lower ends, desirably decreasing more rapidly in an upward than in a downward direction.

When the grip of FIGS. 9 to 13 is in use, the user holds the grip in the same manner discussed in connection with the first form of the invention, with the outer slightly deformable surfaces of the elastomeric body affording an effective but cushioned contact between the hand and the grip. When the gun is fired, the recoiling force is taken in part by compression of the rear cross strap portion at the location of air filled cushioning recess 66, to avoid discomfort of the upper portion of the hand at the location at which the greatest recoil force is normally exerted.

FIGS. 14 and 15 illustrate another form of the invention which may be the same as that of FIGS. 9 to 13 except with regard to the type of recess which is formed in the rear cross strap portion of the grip. More specifically, the grip of FIGS. 14 and 15 includes a body 80 of elastomeric material molded to form two opposite side sections 81 shaped in correspondence with sections 63 and 64 of FIG. 10 and containing reinforcing plates 181 such as those shown at 71 and 72 in FIG. 10, with sections 81 being integrally connected together by a rear cross strap portion 82 and being retained together by a screw passing through registering apertures 83. The recoil absorbing effect in FIGS. 14 and 15 is attained by provision in the rear cross strap portion 82 of a number of forwardly facing preferably rectangular recesses or compartments 84, which may together define a vertical cross-section such as that shown in FIG. 14, and which may be separated from one another by vertical and horizontal partitions 85 and 185 of the elastomeric material. The forward edges 86 of the vertical and horizontal partitions may engage directly against the rear surface 87 of the gun handle. When the gun is fired, the upper portion of the rear cross strap is given increased front to rear compressability by virtue of the presence of the air filled cushioning recesses 84, to effectively absorb a large part of the recoiling force and avoid discomfort to the user as a result of that force.

FIGS. 16 and 17 show another form of the invention which may be the same as that illustrated in FIGS. 9 through 13, except that in lieu of the T-shaped recess or slot there is provided a vertically elongated shallow forwardly facing groove 88, in the front side of the rear cross strap portion 89 of the elastomeric body 90, that groove in this instance being filled with a vertically elongated strip of soft cushioning material, such as an appropriate rubber or plastic foam, which is more readily compressable in a front to rear direction than is the elastomeric material of the main body of the grip. Thus, instead of an air filled cavity, there is provided a cavity or recess containing another substance other than air which is more compressable than the main elastomeric material of the body and its cross strap, and which therefore increases the front to rear compressability and assists in taking recoil force.

While certain specific embodiments of the present invention have been disclosed as typical, the invention is of course not limited to these particular forms, but rather is applicable broadly to all such variations as fall within the scope of the appended claims.

We claim:

1. A pistol grip comprising:

a grip body of elastomeric material adapted to be connected to the frame of a pistol with said frame projecting forwardly from an upper portion of the grip body;

said elastomeric material containing a recess within which a grip mounting portion of said frame extends downwardly;

said body being dimensioned to be gripped in the hand of a user when attached to the pistol frame, with the user's fingers extending across the front of the grip body, and with outer surfaces of said elastomeric material exposed for contact with the user's hand;

said elastomeric material containing a cushioning recess which is located rearwardly of said first mentioned recess and gives to the grip body greater compressibility in a front to rear direction at that location than if said elastomeric material were solid at the location of the cushioning recess, to thereby increase the absorption of recoil force.

2. A pistol grip as recited in claim 1, in which said elastomeric material of the grip body includes a single integral mass of elastomeric material forming opposite side surfaces of the grip body and also forming a rear surface extending between said side surfaces and behind said cushioning recess.

3. A pistol grip as recited in claim 1, in which said elastomeric material of the grip body extends substantially entirely circularly about said grip mounting portion of the gun frame and has portions received at opposite sides of said grip mounting portion and at the rear of said grip mounting portion and extending across the front thereof.

4. A pistol grip as recited in claim 1, in which said first mentioned recess for receiving said grip mounting portion of the gun frame opens generally upwardly, and said cushioning recess in the elastomeric material opens generally upwardly at a location behind said first mentioned recess.

5. A pistol grip as recited in claim 1, including reinforcing material stiffer than said elastomeric material embedded in the elastomeric material of the grip body.

6. A pistol grip as recited in claim 1, including a resilient material which is more readily compressible than said elastomeric material of the grip body and is contained within said cushioning recess.

7. A pistol grip as recited in claim 1, in which said cushioning recess opens forwardly into said first mentioned recess.

8. A pistol grip as recited in claim 1, in which said first mentioned recess opens upwardly.

9. The combination including a pistol grip as recited in claim 1, and a pistol having a frame connected to said grip with a grip mounting portion of the frame extending downwardly within said first mentioned recess and in front of said cushioning recess.

10. For use with a gun having a frame with a pistol grip mounting projection extending downwardly from the frame along essentially a predetermined axis:

a pistol grip detachably connectable to said frame and containing a recess for receiving said projection in a relation enabling movement of the grip relative to the frame generally upwardly and downwardly and essentially along said axis between a mounted position in which the projection extends into the recess and a separated position in which the projection is withdrawn from the recess;

said pistol grip being adapted to pass therethrough a fastener connectable to said frame to retain the grip in said mounted position;

said pistol grip including a body of elastomeric material extending about said recess and having external gripping surfaces at its opposite sides and at the back of the grip for cushioned engagement with a user's hand, and a reinforcing structure embedded in and stiffer than said elastomeric material;

said elastomeric material containing a cushioning recess which is located rearwardly of said first mentioned recess and gives to the grip body greater compressability in a front to rear direction behind said first mentioned recess than if said elastomeric material were solid at the location of said cushioning recess, to thereby increase the absorption of recoil force.

11. A grip as recited in claim 10, in which said reinforcing structure has portions received at opposite sides of said first mentioned recess at locations to axially overlap said projection in said mounted position of the grip, and has a portion positioned to be clamped upwardly by said fastener to retain the reinforcing structure between the fastener and frame and thereby secure the grip to the frame.

12. A grip as recited in claim 10, in which said cushioning recess opens generally upwardly at a location behind said first mentioned recess.

13. A grip as recited in claim 10, in which said reinforcing structure is essentially tubular about said axis and about said first mentioned recess, said cushioning recess opening generally upwardly at a location behind said essentially tubular reinforcing structure.

14. A grip as recited in claim 10, in which said reinforcing structure forms essentially a tube extending about said axis and has a portion at its lower end adapted to be clamped upwardly by said fastener.

15. A grip as recited in claim 10, in which said reinforcing structure is formed essentially as a tube extending about said axis and slidably receiving said projection and having an upper end edge applying upward clamping force to the frame about said projection.

16. A grip as recited in claim 10, in which said reinforcing structure is essentially tubular and dimensioned to closely slidably receive said projection and has a lower portion with a sidewall deformed inwardly at a plurality of circularly spaced locations to form a restriction through which said fastener extends and against which the fastener exerts upward clamping force.

17. A grip as recited in claim 16, in which said first mentioned recess and said tubular reinforcing structure open essentially upwardly, and said cushioning recess is located behind said essentially tubular reinforcing structure and opens upwardly therebehind.

18. A grip as recited in claim 17, in which said tubular reinforcing structure has a front wall which is slit and deformed forwardly.

19. The combination comprising a pistol grip as recited in claim 10, and a pistol having a frame with a grip mounting projection extending into said first mentioned recess, and a fastener extending upwardly through the tubular reinforcing structure and connected to said projection and having a head applying clamping force to said reinforcing structure to hold the grip on the gun frame.

20. A pistol grip comprising:

a grip body of elastomeric material adapted to be received about a pistol handle with the frame of the pistol projecting forwardly from an upper portion of the grip body;

said body being dimensioned to be gripped in the hand of a user when attached to the pistol handle with the user's fingers extending across the front of the body;

said body including two opposite side portions adapted to be received at opposite sides respectively of the pistol handle, and a rear cross strap portion secured permanently to and connecting together said two opposite side portions at rear edges thereof and adapted to extend across the back of the pistol handle; and reinforcing material stiffer than said elastomeric material embedded in the elastomeric material of said two opposite side portions to reinforce it;

said grip body containing a recess between said two opposite side portions within which said pistol handle extends downwardly;

said elastomeric material of the rear cross strap portion of said grip body containing a cushioning recess which is located rearwardly of said first mentioned recess and gives to the grip body greater compressability in a front to rear direction behind said pistol handle than if said elastomeric material were solid at the location of said cushioning recess, to thereby increase the absorption of recoil force.

21. A pistol grip as recited in claim 20, in which said elastomeric material of the grip body forms at least one forward flange carried by one of said side portions of the body at a forward edge thereof and projecting laterally inwardly at a location to be received in front of the pistol handle.

22. A pistol grip as recited in claim 20, in which said reinforcing material in said two opposite side portions of the pistol body contains apertures for passage of fasteners therethrough to connect the side portions to the pistol handle.

23. A pistol grip as recited in claim 20, in which said elastomeric body forms two forward flanges carried by said two side portions respectively at forward edges thereof and projecting laterally inwardly toward one another at locations to both be received in front of the pistol handle in close proximity to one another.

24. A pistol grip as recited in claim 23, in which said cushioning recess opens forwardly into said first mentioned recess.

25. A pistol grip as recited in claim 23, in which there are a plurality of said cushioning recesses in said cross strap portion at vertically spaced locations and opening forwardly into said first mentioned recess.

26. A pistol grip as recited in claim 23, in which said cushioning recess is vertically elongated and opens forwardly into said first mentioned recess, and is essentially T-shaped in horizontal section, having a wide rear portion and a reduced width portion extending forwardly therefrom into said first mentioned recess.

27. A pistol grip as recited in claim 20, in which said cushioning recess is vertically elongated and opens forwardly into said first mentioned recess, and is essentially T-shaped in horizontal section, having a wide rear portion and a reduced width portion extending forwardly therefrom into said first mentioned recess.

28. A pistol grip as recited in claim 20, in which there are a plurality of said cushioning recesses in said cross strap portion at vertically spaced locations and opening forwardly into said first mentioned recess.

29. A pistol grip as recited in claim 20, including resiliently deformable material having greater compressability than said elastomeric material of the grip body and received within said cushioning recess.

30. A pistol grip as recited in claim 20, in which said cushioning recess is vertically elongated and opens forwardly into said first mentioned recess, there being a vertically extending strip of foam cushioning material more compressable than said elastomeric material of the gun body and extending vertically within said cushioning recess and bonded to said elastomeric material in the cushioning recess.

31. A gun grip comprising:

a grip body of elastomeric material adapted to be connected to the frame of a gun; and an essentially tubular reinforcing element embedded within the elastomeric material of the grip body and adapted to receive a terminal projection of the gun frame, and formed of a material stiffer than the elastomeric material;

said essentially tubular reinforcing element having a side wall with localized portions thereof deformed radially inwardly at circularly spaced locations and beyond circularly intermediate portions of the wall which are not so deformed, to form a restriction defined by said inwardly deformed wall portions; and a fastener adapted to extend through said restriction and having a head of a diameter greater than the restriction formed by the inwardly deformed portions of the sidewall of said tubular element to apply force axially to the inwardly deformed portions of the side wall to retain the grip body on a gun handle.

32. A gun grip as recited in claim 31, in which said tubular reinforcing element is formed of square tubing deformed inwardly on four sides thereof between its four corners.

33. A gun grip as recited in claim 31, in which said reinforcing element is formed of tubing of circular cross-section deformed inwardly at four evenly circularly spaced locations.

34. A gun grip as recited in claim 31, in which said tubular element is deformed in a manner leaving radially outwardly projecting gaps between circularly successive inwardly deformed portions of the tubing within which elastomeric material of said body is received to enhance the mechanical connection of the tubular element to the elastomeric material.

* * * * *